United States Patent [19]

Campbell

[11] Patent Number: 4,767,370

[45] Date of Patent: Aug. 30, 1988

[54] SAILBOARD WATERCRAFT

[76] Inventor: Brian C. Campbell, P.O. Box 4091, George East, 6539 Cape Province, South Africa

[21] Appl. No.: 9,207

[22] Filed: Jan. 30, 1987

[51] Int. Cl.[4] ..... A63C 15/05

[52] U.S. Cl. ..... 441/74; 440/68; 114/288; 441/65

[58] Field of Search ..... 441/74, 65; 440/66, 440/68, 69; 114/288, 289, 290, 62; D21/228, 229, 230, 236; D12/310

[56] References Cited

U.S. PATENT DOCUMENTS

| | | | |
|---|---|---|---|
| 890,045 | 6/1908 | Granrose . | |
| 1,007,583 | 10/1911 | Loetzer | 440/69 |
| 3,158,882 | 12/1964 | Kibby . | |
| 3,289,227 | 12/1966 | Kelly, Jr. | 441/74 |
| 3,422,778 | 1/1969 | Halfon . | |
| 4,068,611 | 1/1978 | Leather . | |
| 4,476,798 | 10/1984 | Bachus . | |

FOREIGN PATENT DOCUMENTS

| | | | |
|---|---|---|---|
| 2828858 | 1/1980 | Fed. Rep. of Germany . | |
| 3121402 | 12/1982 | Fed. Rep. of Germany . | |
| 3320331 | 12/1984 | Fed. Rep. of Germany | 114/288 |
| 3329145 | 3/1985 | Fed. Rep. of Germany . | |
| 3422406 | 12/1985 | Fed. Rep. of Germany . | |
| 2519930 | 7/1983 | France . | |
| 2525482 | 10/1983 | France . | |

*Primary Examiner*—Galen Barefoot
*Assistant Examiner*—Paul E. Salmon
*Attorney, Agent, or Firm*—Harness, Dickey & Pierce

[57] ABSTRACT

A sailboard has a hull (10) which is of smooth rounded elongated shape of little depth and tapers down in width and in depth from its middle region to its ends. The hull has an overall length from to five times its width and has an enclosed air passage along its underside extending longitudinally for at least a part of its length from a front air inlet opening (14) to a rear air outlet opening (16).

13 Claims, 1 Drawing Sheet

SAILBOARD WATERCRAFT

This invention relates to watercraft. It relates in particular to a hull for watercraft such as a sailboard.

SUMMARY OF INVENTION

According to the invention there is provided a hull for a water craft which has an enclosed air passage extending longitudinally along at least part of its length along its underside from a front air inlet opening to a rear air outlet opening.

Both of the said openings may be on the underside of the hull, or the air inlet opening may be on the upper side of the hull. The air inlet opening may be in the front quarter of the length of the hull, and the air outlet opening may be in the rear one third of the length of the hull.

The passage may be provided in the hull by having a channel formed on its underside and by then covering the channel along part of its length by a panel serving as a floor for the passage.

The passage may have a length in the range of the 3/5ths to ¾ the length of the hull, preferably about ⅔rds the length of the hull. The passage may be straight from front to back, ie not following the contour of the undersurface of the hull.

The passage may converge in width from its front air inlet opening rearwardly to a throat, and may diverge again in a downstream direction, away from the throat to the air outlet opening. The converging and diverging sides of the passage defining the width of the passage may converge and diverge uniformly. The included angle defined by the converging sides of the passage at the air inlet opening and upstream of the throat may be 60° at the most, but is preferably about 30°. The included angle defined by the sides of the passage diverging away from the throat may be 30° at the most, but is preferably about 10°.

The throat may be 1/5th to ¼ of the length of the hull from the air inlet opening. The length of the throat may be ⅛th to 1/12th, preferably 1/10th, of the overall length of the passage, and the width of the throat may be about one-half the maximum width of the passage.

The maximum width of passage may be 8 to 14 times its minimum depth, but is preferably 10 to 12 times its minimum depth. The depth of the passage at the inlet opening may be about 2½ cm to 3 cm, and at the throat 1 cm to 3 cm.

The passage may have a plurality of openings leading transversely out of the passage at its trailing edge, upstream from the air outlet opening. The openings may be spaced across the width of the passage.

The water craft may be a sailboard and the hull may be of smooth rounded elongated shape of little depth and may taper down in width and in depth from its middle region to its ends, and may have an overall length from four to five times its maximum width, and the passage may have a width which is about ½ to ⅓rd the maximum width of the hull.

The invention will now be described by way of example with reference to the accompanying diagrammatic drawings.

DETAILED DESCRIPTION

Figure 1:
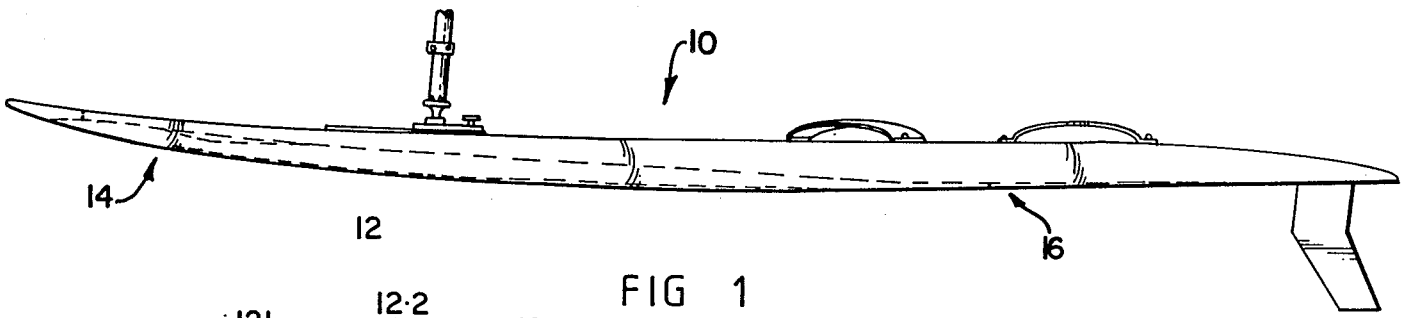
FIG. 1 shows a side view of a sailboard according to the invention.
Figure 2:
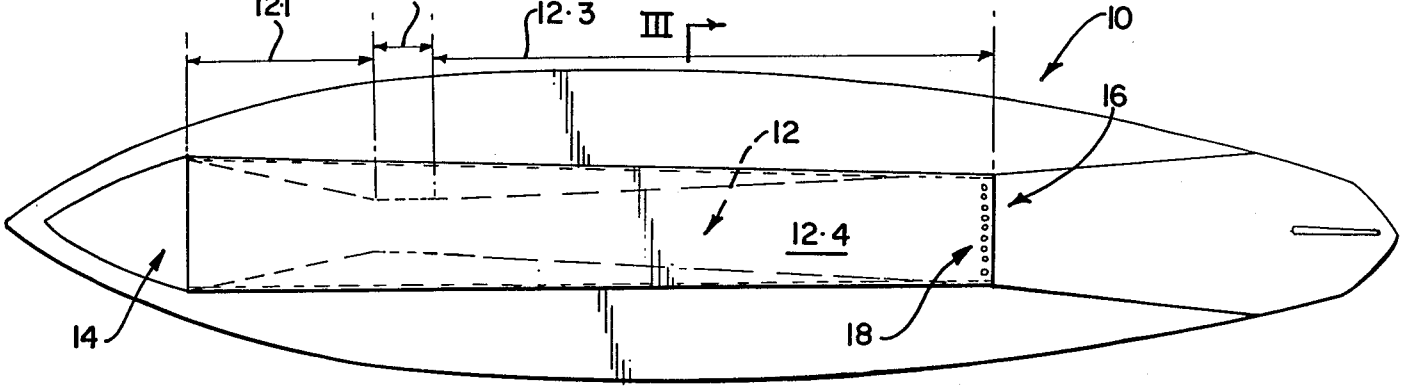
FIG. 2 shows a view of the underside of the sailboard of FIG. 1.
Figure 3:
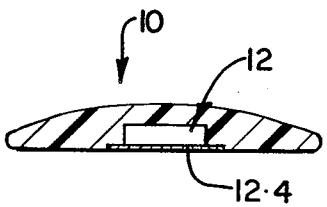
FIG. 3 shows a cross-section at III—III in FIG. 2.

Referring to the drawings, reference numeral 10 refers generally to a hull in accordance with the invention, for a sailboard. The hull 10 has an air passage 12 having a front air inlet opening 14 at the front end, and a rear air outlet opening 16 at the rear end. The air passage 12 has a leading convergent portion 12.1, then a parallel throat portion 12.2, and finally a trailing divergent portion 12.3. The air passage 12 is formed by a channel in the underside of the hull, which is then covered over with a floor 12.4. A plurality of aspirating openings 18 are provided in a row at the trailing end of the floor 12.4.

In a particular embodiment having a hull about three metres long, the depth of the passageway at the throat is about 1½ cm, and the depth at the entrance of the passageway is about 2½ cm. The cross-sectional area of the outlet opening 16 out of the passageway is about equal to the cross-sectional area of the inlet opening into the passageway.

In use, it is believed that air will pass along the air passageway, and will provide additional buoyancy to the hull. Furthermore, it is believed that the openings 18 at the trailing end of the floor 12.4 will assist in breaking adhesion of water to the underside of the hull. While the applicant does not wish to be bound by theory, it is believed that the air passageway, besides improving the buoyancy of the hull, acts in a fashion to improve the handling and performance of the sailboard.

I claim:

1. An elongated hull for a water craft such as a sailboard which has a front end and a rear end and which has length, width, and an underside and which has an elongated enclosed air passage which has length and depth, and a width which varies along the length of the passage, the passage being formed on the underside of the hull by an elongated longitudinal inverted channel recess and by a panel covering the channel recess along part of its length intermediate its ends, the panel having a leading edge and a trailing edge and serving as a floor for the passage, the passage having a maximum width which is eight to fourteen times its depth, and extending longitudinally for at least three-fifths of the length of the hull from a front air inlet opening which is on the underside in the front one-fourth of the length of the hull, to a rear air outlet, opening on the underside of the hull in the rear one-third of the length of the hull, the width of the air passage being defined by sides which converge rearwardly from the front air inletopening to a throat and which diverge again rearwardly away from the throat to the rear air outlet opening.

2. A hull as claimed in claim 1, in which the converging sides of the passage at the air inlet opening define an included angle which is 60° at the most, and in which the diverging sides of the passage from the throat define an included angle which is 30° at the most.

3. A hull as claimed in claim 1, in which the throat is 1/5th to ¼ of the length of the hull from the air inlet opening.

4. A hull as claimed in claim 1, in which the length of the throat is ⅛th to 1/12th of the overall length of the passage, and the width of the throat is about half the maximum width of the passage.

5. A hull as claimed in claim 1, in which the water craft is a sailboard and in which the hull is of smooth rounded elongated shape of little depth and tapers down in width and in depth from its middle region to its ends, and has an overall length from four to five times its maximum width, and in which the passage has a maximum width which is about ½ to ⅓rd the maximum width of the hull.

6. A hull as claimed in claim 5, in which the passage has an overall length 3/5 to ¾ the overall length of the hull, and in which the sides of the converging portion of the passage define an included angle of about 30° and the sides of the diverging portion define an included angle of about 10°, and in which the throat has a length which is about one-tenth the overall length of the passage.

7. A hull as claimed in claim 6 in which the passage at the inlet opening is about 2 cm to 3 cm deep, and the throat is about 1 cm to 3 cm deep.

8. An elongated hull for a water craft such as a sailboard which has a front end and a rear end and length, width and depth and an underside, and which has an enclosed elongated air passage which has length and varying width and depth, and which has a maximum width which is eight to fourteen times its minimum depth, the passage extending longitudinally for at least three-fifths of the length of the hull along its underside from an air inlet opening which is in the front quarter of the length of the hull, to an air outlet opening which is in the rear one-third of the length of the hull on its underside, the air passage having sides which converge rearwardly in width from the front air inlet opening to a throat and which diverge again rearwardly in width, away from the throat to the rear air outlet opening, and the passage having a plurality of openings on its underside spaced transversely in a row across its width, the openings leading transversely out of the passage at its trailing edge, upstream from the air outlet opening.

9. An elongated hull for a water craft such as a sailboard which has a front end and a rear end and length, width, and depth and an underside, and which has an elongated enclosed air passage having length and depth, and a width which is eight to fourteen times its depth, the passage extending longitudinally for at least three-fifths of the length of the hull along its underside from a front air inlet opening in the front quarter of the length of the hull on its underside, to a rear air outlet opening on the underside of the hull in the rear one-third of the length of the hull, the air passage being formed by an elongated longitudinally disposed inverted channel recess on the underside of the hull, and by a panel having a leading end and a trailing end covering the channel along part of its length intermediate its ends, from the front air inlet opening to the rear outlet opening, the panel forming a floor for the passage.

10. A hull as claimed in claim 9, in which there is provided a plurality of openings spaced transversely across the width of the panel, upstream of its trailing end, and leading out of the passage.

11. A hull as claimed in claim 9, in which the channel has a throat portion defined by laterally spaced sides having upstream ends and downstream ends; an upstream portion having a width defined by sides which converge rearwardly towards and join with the upstream ends of the sides defining the throat portion; and a downstream portion whose width is defined by sides which diverge rearwardly, away from the downstream ends of the sides defining the throat portion.

12. A hull as claimed in claim 11, in which the throat portion is disposed one-fifth to one-quarter of the length of the hull from the air inlet opening.

13. A hull as claimed in claim 11, in which the throat portion has a length which is one-eighth to one-twelfth of the overall length of the passage.

* * * * *